United States Patent [19]

Tajiri et al.

[11] 4,452,160

[45] Jun. 5, 1984

[54] METHOD OF MANUFACTURING A CUT PILE CARPET

[75] Inventors: Koji Tajiri; Mikio Oohara; Kiyoshi Maruo, all of Mihara, Japan

[73] Assignee: Teijin Limited, Hiroshima, Japan

[21] Appl. No.: 441,239

[22] Filed: Nov. 12, 1982

Related U.S. Application Data

[63] Continuation of Ser. No. 112,465, Jan. 16, 1980, abandoned, which is a continuation-in-part of Ser. No. 56,843, Jul. 12, 1979, Pat. No. 4,355,592.

[51] Int. Cl.[3] ..... D02G 1/02; D06C 27/00; D05C 17/02

[52] U.S. Cl. ..... 112/410; 57/205; 57/247; 57/251; 57/284; 57/290; 57/293

[58] Field of Search ..... 112/410; 28/159; 57/204, 205, 242, 243, 246, 247, 251, 284, 286, 290, 293

[56] References Cited

U.S. PATENT DOCUMENTS

| | | | |
|---|---|---|---|
| 2,815,559 | 12/1957 | Robinson | 57/286 X |
| 2,961,010 | 11/1960 | Berry | 57/204 X |
| 3,058,291 | 10/1962 | Heberlein et al. | 57/247 |
| 3,553,953 | 1/1971 | Ponson | 57/251 |
| 3,576,702 | 4/1971 | Matsui et al. | 112/410 X |
| 3,611,698 | 10/1971 | Horn | 57/246 X |
| 3,828,542 | 8/1974 | Boutonnet et al. | 57/286 X |
| 3,916,651 | 11/1975 | Carruthers | 28/281 X |
| 3,967,441 | 7/1976 | Yasuzuka et al. | 57/247 |
| 3,968,638 | 7/1976 | Norton et al. | 57/247 |
| 3,971,200 | 7/1976 | Richter | 57/290 |
| 4,114,549 | 9/1978 | Chambley et al. | 57/204 X |
| 4,290,378 | 9/1981 | Wilkie | 112/410 |
| 4,355,592 | 10/1982 | Tajiri et al. | 112/410 |

*Primary Examiner*—Robert Mackey

*Attorney, Agent, or Firm*—Burgess, Ryan & Wayne

[57] ABSTRACT

A pile yarn for a carpet and a cut pile carpet.

A bulky yarn of a polyamide multifilament is fed to a false twisting and heat setting device where filaments in the yarn are thermally and partially adhered to each other while the yarn is false twisted. A bulky cohesive continuous multifilament yarn thus obtained has alternate twists therein along the lengthwise direction thereof and a latent torque therein, and after it is heat treated under a constrained condition, preferably by means of saturated or superheated steam, so that the torque in the yarn is lowered, it is tufted on a substrate of a carpet as a pile yarn and the piles are cut.

2 Claims, 14 Drawing Figures

METHOD OF MANUFACTURING A CUT PILE CARPET

CROSS REFERENCE OF THE APPLICATION

The present application is a continuation of application Ser. No. 06/112,465 filed Jan. 16, 1980, now abandoned, which application is a continuation-in-part of application Ser. No. 06/056,843 filed July, 12, 1979, now U.S. Pat. No. 4,355,592 granted Oct. 26, 1982.

BRIEF DESCRIPTION OF THE INVENTION

The present invention relates to a pile yarn for a carpet and a novel cut pile carpet. More specifically, the present invention relates to a cohesive bulky carpet yarn of a polyamide continuous multifilament which is preferably for use as a pile yarn in a cut pile carpet and a method for industrially manufacturing the same, and a cut pile carpet wherein the pile yarn is tufted and a process for manufacturing the same.

BACKGROUND OF THE INVENTION

Recently, a bulky polyamide continuous multifilament yarn has been utilized in a tufted carpet, especially a cut pile carpet. In this case, when the bulky polyamide continuous multifilament yarn is used in a shaggy and saxony carpet, the bulky multifilament yarn which is obtained after a multifilament yarn receives a turbulent jet of heated fluid or a stuffing operation of fluid, generally receives additional twists between 30 T/m and 250 T/m, and then it is heat set by means of saturated steam, dry heat or the like so that the twists therein are set. Thereafter, the bulky yarn is utilized in a carpet as a pile yarn.

Such a bulky yarn obtained after twisting and heat setting has both preferable bulkiness adjusted by heat setting and suitable coherency caused by twisting. As a result, when the yarn is utilized in a cut pile carpet, the filaments of each cut pile gather together to form a slender shape like a pencil (this will be called a pin-point effect hereinafter), and the carpet has good quality. However, the cohesive bulky yarn obtained after twisting and heat setting has some problems. One of the problems is that the manufacturing cost of the yarn is high because the yarn requires two additional separate operations, i.e., twisting and heat setting. Another problem is that the yarn loses the above-mentioned pin-point effect and the hand and appearance thereof becomes felt-like after the cut pile carpet with pile yarns of the above-mentioned bulky yarn is utilized for a long duration because its coherency lowers gradually.

To eliminate the above-mentioned problems, methods have been attempted wherein the twisting and heat setting operations of the bulky yarn for carpet pile yarn are omitted and another method is carried out to impart coherency to the yarn. For example, in U.S. Pat. No. 3,611,698, a bulky yarn is entangled by means of a fluid flow so that a high degree of interlace is imparted therein. In U.S. Pat. No. 3,968,638, a bulky yarn is also false twisted by means of a fluid jet after it is interlaced so that latent twists are imparted therein. However, due to these methods, it is difficult to impart to a bulky polyamide multifilament yarn having a thick denier a uniform coherency along a lengthwise direction of the yarn by means of interlacing. In addition, highly entangling portions have an excessive coherency, and non-uniformity of dyeability or dyeing specks may occur.

As a result, there is caused an additional problem in that the quality of a carpet is substantially degraded.

In accordance with the method disclosed in another U.S. Pat. No. 3,971,200, the pile yarn is maintained in a non-twisted situation. As a result, the yarn may split and filaments composing the yarn may be slack. Since the whole yarn does not have sufficient coherency, the operabilities, especially tufting operability, of the yarn are low.

The yarn disclosed in the above-mentioned U.S. Pat. No. 3,968,638 is not wholly as cohered as a true twisted yarn, and opened and entangled portions are alternately distributed along the yarn. In the opened portions of the yarn, splitting of the yarn and slacking may occur, and problems occur in that the yarn becomes entangled with machine parts or another yarn and the yarn is split by means of tufting needles while the yarn is being tufted.

SUMMARY OF THE INVENTION

The inventors of the present invention have studied various bulky cohesive polyamide multifilament yarns which can be utilized in a cut pile carpet as a pile yarn so that a bulky yarn can be provided which does not have any of the above-mentioned problems and which can form a cut pile carpet with a high quality. The inventors have accomplished the present invention after they found that a novel bulky polyamide multifilament yarn which is distinguished from the known bulky yarns can be obtained with a false twisting and thermal and partial adhering operation is introduced, which has never before been carried out in this field.

More specifically, a cohesive bulky carpet yarn of a polyamide continuous multifilament according to the present invention is characterized in that the total crimp of the yarn is between 3% and 15%, that filaments composing the yarn are partially and thermally adhered to each other and the yarn has alternate twists so that S and Z twist portions are distributed randomly along the lengthwise direction of the yarn, and that the yarn has a coherent factor between 5 and 100 and a latent torque index between 20 T/m and 300 T/m.

Another aspect of the present invention pertains to a cut pile carpet wherein the cohesive bulky carpet yarn of a polyamide continuous multifilament is utilized as a pile yarn. In an aspect of the present invention, a preferable embodiment is provided as a cut pile carpet comprising cut piles of a cohesive bulky polyamide multifilament yarn, wherein at least 50% of the filaments composing the cohesive bulky polyamide multifilament yarn are modified cross sectioned filaments, each filament of which multifilament yarn has at least three projections in its cross section, and the filaments are thermally and partially adhered to each other and S and Z twists are randomly distributed along the lengthwise direction of the yarn, and the yarn has a latent torque therein.

A further aspect of the present invention pertains to a method for manufacturing the cohesive bulky carpet yarn of a polyamide continuous multifilament yarn.

A still further aspect of the present invention pertains to processes for manufacturing a cut pile carpet wherein a novel bulky carpet yarn of a continuous polyamide multifilament having partial and thermal adhesion and alternate twists is utilized as a pile yarn.

The first process of the present invention in this aspect comprises: a step of false twisting and thermal adhering a bulky yarn of a polyamide multifilament so that filaments composing the yarn are thermally and partially adhered to each other, and so that alternate twists are distributed in the yarn along the lengthwise direction of the yarn, whereby a cohesive bulky multifilament has a latent torque index between 20 T/m and 300 T/m; a step of tufting the cohesive bulky multifilament yarn as a pile yarn on a substrate; a step of cutting the loops of the pile yarn so as to create cut piles; and a step of heat treating the cut piles by means of steam, dry heat or hot water so that true twists between 20 T/m and 200 T/m are developed in each of the cut piles.

According to the first process, the productivity of a pile yarn is remarkably increased compared with the conventional method wherein a conventional cohesive bulky yarn obtained after twisting and heat setting is utilized, and as a result, the cost for manufacturing the carpet is very much reduced. In addition, if twists in the pile yarn become loose after the carpet has been used for a long period of time, it is possible to develop twists in the pile yarn by heat treating the pile yarn again. However, in some cases, free ends of filaments constituting the cut piles formed on the substrate may be turned or curved when the cut piles are subject to a heat treatment, such as winch dyeing, and as a result, the smoothness of the cut surface of the obtained carpet is degraded. To make the cut surface smooth, the cut surface is generally subjected to a shearing operation. However, if free ends of filaments of the cut piles are turned or curved, it is very difficult to uniformly shear the free ends, and as a result, a carpet having a high quality cannot be obtained.

To eliminate the turning and the curving of filaments of the cut piles, the present invention further provides a second process which comprises: a step of false twisting and thermal adhering a bulky synthetic multifilament yarn, so that filaments composing the yarn are thermally and partially adhered to each other, and so that alternate twists are randomly distributed in the yarn along the lengthwise direction of the yarn, whereby a cohesive bulky multifilament yarn is formed having a latent torque index of between 60 T/m and 300 T/m; a step of heat relaxation treating the bulky yarn under a constrained condition, so that the latent torque index of the bulky yarn is lowered to a value of less than 60 T/m; a step of tufting the heat treated bulky yarn as a pile yarn on the substrate, and; a step of cutting the loops of the pile yarn so as to create cut piles.

With the second process, a cut pile carpet having a smooth cut surface can be obtained. The cut pile carpet thus obtained comprises a substrate and cut piles tufted on the substrate so as to be protruded therefrom. The cut piles are composed of a cohesive bulky synthetic thermoplastic yarn, which has a total crimp of between 3% and 10%. The filaments constituting the yarn are thermally and partially adhered to each other, and have alternate twists therein so that S and Z twist portions are randomly distributed along the lengthwise direction of the yarn. Furthermore, the yarn has a latent torque index of less than 60 T/m. If the cut pile carpet obtained according to the second process has a latent torque index equal to or more than 60 T/m, or a total crimp higher than 10%, the free ends of the filaments may turn or curve easily, and accordingly, it is very difficult to make the cut surface flat. If the total crimp is less than 3%, the bulkiness of the pile yarn is unsatisfactory, and as a result, the hand of the cut pile carpet is inferior to that when the total crimp is 3% or more. Since in the pile yarn utilized in the second process, the filaments are closely adhered to each other, it is preferable that the mean denier of the individual filaments be not more than 15 de, so that the hand of the yarn will be soft enough for a carpet. However, if the mean denier of the filaments is less than 3 de, the hand becomes too soft. Accordingly, it is preferable that the mean denier of the filaments be between 3 de and 15 de, and more preferably, between 5 de and 12 de. The denier of the filaments may be uniform, and in some cases filaments varying in denier between 1 de and 50 de may be blended.

It is preferable that at least 50 percent of the multifilaments composing the cohesive bulky yarn of the present invention be made of polyamide, and it is desirable that the filaments be substantially made of aliphatic polyamide, for example nylon 6, nylon 66 or their copolymer, which easily increases its adhesion under the function of water molecules and has a tendency to thermally and partially adhere. It is also preferable that the total denier of the multifilament yarn is between 600 de and 6000 de, desirably between 900 de and 3000 de, and that the thickness of each filament in denier of the multifilament yarn is between 6 de and 30 de. The cross sectional shape of each filament may be a regular circular shape, or a non-circular shape, such as triangular, square, cross, Y-shape, T-shape or trilobal shape. The filament may have one or more hollows continuously formed therewithin along the lengthwise direction thereof. The bulky cohesive yarn may have not only crimps, but also, loops or slacks of filaments so that the hand of the yarn is soft.

According to the present invention, it is possible to constitute the multifilament yarn with more than two kinds of filaments. For example, the yarn may be composed of two or more kinds of filaments which are different from each other in the polymers, the cross sectional shapes of the filaments, thicknesses in denier of the filaments, the thermal properties, the mechanical properties, the dyeabilities and the like. The yarn may be made of polymer which is a combination of a polyester (polyethylene terephthalate or polybuthylene terephthalate) and a polyamide (nylon 6 or nylon 66), a combination of a polypropylene and polyamide or a combination of different polyamides (nylon 6 and nylon 66). In some cases, a part of the filaments may be a filament having an electric conductivity. These filaments may be doubled or blended.

The bulky yarn of the present invention may have crimps of any shape; however, it is preferable that the yarn has non-helical crimps imparted by the turbulent jet of heated fluid, stuffing by fluid or mechanical stuffing. When the yarn has non-helical crimps, in the case wherein the bulky yarn is utilized as a pile yarn in a cut pile carpet, it is preferable that the total crimp is selected between 3% and 15%, more desirably between 5% and 10%, by varying the draft ratio while the yarn is being false twisted. This is because, if the total crimp exceeds 15%, the obtained carpet may be felt-like; and if the total crimp is less than 3%, the quality of the carpet may be low because the carpet is not voluminous. Accordingly, it is preferable for a cut pile carpet with a good quality to have a total crimp between 3% and 15%.

According to the method of the present invention, the above-mentioned bulky yarn is fed to a false twisting and heat setting device so that false twists are imparted in the yarn and so that filaments composing the yarn become thermally and partially adhered to each other. Subsequently, the yarn is detwisted and taken up without removing the partial adhesion. In this case, it is highly preferable that false twists between 100 T/m and 1000 T/m are imparted into the yarn by means of circulated air, and that then the false twists are heat set by means of saturated or superheated stream at a temperature higher than that where adhesion begins. The operating speed of the yarn is usually selected between 100 m/min and 2000 m/min. However, if the above-mentioned false twisting and heat setting operation is carried out together with spin-draw operation, the operating speed in the false twisting operation selected is between 1000 m/min and 5000 m/min.

As a result of the above-mentioned false twisting and heat setting operation, the portions where the thermal and partial adhesion occurs remain in the yarn as tight spots. To compensate for the tight spots, twists in a reverse direction are created in the yarn. As a result, a bulky yarn with alternate twists, wherein filaments are thermally and partially adhered to each other and S and Z twists are distributed randomly along the lengthwise direction thereof, is obtained. The bulky yarn includes a latent torque which was imparted through the false twisting and thermal adhering operation; in other words the yarn has a latent torque index, which is measured in accordance with the test method explained hereinafter, of between 20 T/m and 300 T/m.

The term "thermal and partial adhesion" in the present specification means a situation wherein a plurality of filaments are incompletely adhered to each other due to thermal adhesion. In other words, the degree of adhesion is not so high that the entire multifilament yarn is integrated in one body. Since the filaments are partially adhered, so that only the cohesion of the yarn can be maintained, the filaments can easily be separated from each other when a separating force is exerted on the yarn.

The term "alternate twists" means that S and Z twist portions are randomly distributed along the lengthwise direction of the bulky yarn. Since the partial and thermal adhesion is created while the yarn is twisted due to the false twisting and thermal adhering operation, the adhered portions remain randomly in the bulky yarn as tight spots. As a result, when the yarn is detwisted, twists in an opposite direction are created to compensate for the tight spots, as if the yarn is overly detwisted. Accordingly, when the yarn is observed in its entirety, the yarn has a cohesion, as uniform as a true twisted yarn has, along the lengthwise direction thereof and has a substantially circular cross section.

It is suitable that the coherency imparted to the bulky yarn by means of partial and thermal adhesion is between 5 and 100 in the coherent factor, which is measured in accordance with the test method explained hereinafter. If the coherent factor is smaller than 5, the coherency of the yarn is not sufficient so that the operabilities, especially tufting operability, are degraded, and the obtained cut pile carpet may be felt-like; in other words, the carpet may not have a good pin point effect. On the other hand, if the coherent factor exceeds 100, the coherency of the yarn is too high and the carpet is not voluminous. In addition, the hand of the carpet may be hard, and therefore such a high coherent factor is not desired. The coherent factor can be selected at a desired amount by varying the condition explained hereinafter, wherein the heat setting takes places during the false twisting and thermal adhering operation.

In the present invention it is more preferable that the coherent factor be between 10 and 50. When the coherent factor between the above-mentioned range is utilized, since the bulky yarn is suitably voluminous and has a coherency, the cut pile carpet obtained will be the best in quality. It should be noted that when a bulky interlaced yarn disclosed in the above-mentioned U.S. Pat. No. 3,968,638 is utilized, the coherency is low and the handling operability is poor if a relatively low coherency is imparted to the yarn; for example, if the coherent factor is not more than 15. On the other hand, the cohesive bulky multifilament yarn according to the present invention can maintain good coherency even if the coherent factor is between 5 and 15, because the yarn has alternate twists therein and maintains a circular cross section. As a result, the yarn has a good handling operability such as that of the yarn produced according to the known twisting and heat setting method.

The degree of partial and thermal adhesion is expressed by an adherent ratio which is defined as a percentage of the number of adhered portions to the number of whole filaments. It is preferable that the adherent ratio be between 0.5% and 40%. More specifically, if the degree of adhesion is too large, i.e., the adherent ratio exceeds 40%, the bulky yarn has a hard hand, and a carpet having a good quality cannot be obtained. On the other hand, if the degree of adhesion is too small, i.e., the adherent ratio is smaller than 0.5%, the effect of the false twisting and thermal adhesion cannot be fully achieved, and in many cases, the yarn does not have either the desired coherent factor or the desired latent torque index.

In addition, a cohesive bulky multifilament carpet yarn according to the present invention is required to have a latent torque between 20 T/m and 300 T/m. The latent torque is measured in a method explained hereinafter and means the property by which true twists are developed in the bulky yarn when the bulky yarn is treated in steam or hot water while one end thereof is free and the bulky yarn is rotated about its axis. Accordingly, when the bulky yarn of the present invention is utilized to manufacture a carpet and when the carpet thus obtained is treated by means of steam or hot water, true twists are naturally developed in the pile yarn which has been cut, and therefore, each cut pile yarn stably coheres.

When the latent torque index is less than 20 T/m, the bulky yarn does not have such a self-twisting effect, and therefore, the cut pile yarns do not cohere. On the other hand, if the latent torque index exceeds 300 T/m, the cut pile yarns cohere excessively, and therefore the hand of the carpet is degraded, and the quality of the carpet is low.

It is preferable that the degree of the latent torque is between 20 T/m and 200 T/m measured in the latent torque index. If a velour-like carpet is desired, a latent torque index between 20 T/m and 80 T/m is preferable. A latent torque index between 60 T/m and 200 T/m is preferable, when a hard twist-like carpet is desired.

The cohesive bulky yarn of a polyamide continuous multifilament according to the present invention has a sufficient amount of coherency due to the existence of both the partial and thermal adhesion and the alterante twists, and at the same time it has a substantially circular cross section which is similar to that of a true twisted yarn. As a result, good handling operabilities, especially tufting operability, can be obtained, and the productivity of a carpet can be increased. Since the yarn does not have strongly entangled portions due to the interlacing, the dyeability thereof is good.

It should be noted that the bulky yarn of the present invention can provide a desired pile yarn having the desired appearance and hand by selecting the degree of the partial and thermal adhesion and the latent torque index. For example, when both the degree of the partial and thermal adhesion and the latent torque index selected are "large", the pile yarn becomes like a hard twist and the hand thereof becomes stiff. When the degree of the partial and thermal adhesion or the latent torque index selected is "small", the hand of the pile yarn becomes soft.

It should also be noted that since the partial adhesion of the bulky yarn according to the present invention can be mechanically separated, if the pile yarns are mechanically treated after the bulky yarn is tufted on a carpet, a part of or all of the partial adhesion can be separated so that a carpet having a soft hand can be obtained.

As mentioned above, a cut pile carpet, wherein a bulky cohesive multifilament yarn is manufactured in accordance with the conventionally known method, gradually loses its cohesive property due to the decrease of twists in the pile yarn after it is used for a long duration. On the other hand a carpet, which is manufactured in accordance with the first process of the present invention by utilizing the bulky carpet yarn according to the present invention, will not lose the twists in the pile yarn even after it is used for a long duration. If the twists are lost, the carpet can recover its twists by being treated with steam or hot water because the pile yarn has latent torque therein.

The above-mentioned bulky cohesive yarn of a polyamide multifilament can be productively and economically manufactured by feeding a bulky yarn of a polyamide multifilament to a false twisting and heat setting device, wherein false twists between 100 T/m and 1000 T/m are imparted to the yarn and the yarn is heat set so that the filaments are thermally and partially adhered to each other, and subsequently by taking up the yarn while the partial and thermal adhesion is left therein.

The fed bulky yarn can be a polyamide multifilament yarn and crimps can be imparted therein in a known manner. Even more preferably, bulky yarns having non-helical crimps imparted by a heated air jet, a gear crimping or a stuffer box crimping, are suitable. For example, a bulky yarn can be utilized which is obtained after a polyamide multifilament yarn is fed into a heated fluid, so that loops or slacks are created in the filaments and is then opened under a predetermined draft ratio, such as disclosed in Japanese Patent Application Publication Nos. 24699/70 and 33430/71. When the draft ratio is low, and the loops and slacks are left in the bulky yarn, a spun-like and voluminous yarn having a soft hand can be obtained. It is also possible in the present invention that two or more kinds of bulky yarns are simultaneously utilized, and in some cases the bulky yarns may be different from each other in the shapes of the crimp, the thicknesses in denier, the modification ratios or the degree of the crimp and the dyeabilities. It is preferable that the total crimp of the bulky yarn be between 3% and 15%.

The total crimp of the bulky carpet yarn can be varied by changing the draft ratio while the yarn is being false twisted and thermally adhered. According to the present invention, if the total crimp of the bulky carpet yarn, i.e., the pile yarn, after it is false twisted and thermally adhered, is in a range between 3% and 15%, a cut pile carpet with a good quality can be obtained.

In a first process according to the present invention, the above-mentioned bulky cohesive multifilament yarn, which is obtained after the false twisting and thermal adhering operation, is utilized. The yarn is tufted on a substrate, e.g. fabrics of jute or split yarn, in a conventionally known manner, after it is dyed if required. The density of the tufting may be changed in accordance with the thickness of the pile yarn. In general, it is preferable that the density be between 4 and 25 per $cm^2$. Thereafter, the loops of the pile yarn which have been formed by the tufting are cut, so that cut piles are formed. The cut piles are steam treated, the temperature of which is between 70° C. and 100° C.; dry heat, the temperature of which is between 100° C. and 160° C.; or hot water, the temperature of which is between 40° C. and 100° C., so that torque latently included in the pile yarn is developed and so that the cut piles are rotated so as to create true twists between 20 T/m and 200 T/m. The coherency of each cut pile depends on the number of the true twists therein. If the true twists are less than 20 T/m, the coherency of the cut pile is not sufficient and the surface of the carpet becomes felt-like. On the other hand, if the true twists are more than 200 T/m, the coherency is excessive and the hand thereof becomes stiff.

The operation for developing the spontaneous true twist in the first process of the present invention may take place together with the scouring operation or the dyeing operation. In some cases, the developing operation may take place separately. Before or after the operation for developing true twists, a mechanical operation, such as a rubbing operation or a raising operation, may be applied to the yarn so that adhesion between the filaments may be removed.

In a second process according to the present invention, the above-mentioned bulky cohesive multifilament yarn having a latent torque index of between 60 T/m and 300 T/m is subjected to a heat relaxation treatment under a constrained condition, in other words while the free movement of the yarn is prevented. As a result, the latent torque index of the cohesive bulky yarn is lowered to less than 60 T/m, in order to relax the latent torque, and the crimp is adjusted. Thereafter, the heat treated cohesive bulky yarn is tufted as a pile yarn on the substrate and, then, the loops of the pile yarns are cut. The heat relaxation treatment may be: a method wherein a bulky yarn which is soft wound in the form of a cheese is subjected to a saturated steam, the temperature of which is between 100° C. and 130° C., in a steam setter; a method wherein the above-mentioned cheese is subjected to a heat treatment simultaneous with a dyeing operation by means of hot water, the temperature of which is between 80° C. and 100° C. and in which a dyestuff is dissolved, or; a method wherein a cohesive bulky yarn is subjected to a heat treatment while the yarn is delivered between two rollers under a predetermined overfeed ratio.

As a result of the heat treatment, the cohesive bulky yarn has a latent torque index of less than 60 T/m, desirably between zero and 40 T/m and a total crimp of between 3% and 10%, desirably between 4% and 8%. The bulky yarn thus obtained has a very small torque therein and the crimp thereof is stabilized at a low level. Accordingly, if the heat treated cohesive bulky yarn is tufted as a pile yarn on a substrate and if the loops of the pile yarn are cut so that a cut pile carpet is manufactured, the turns and curves of free ends of the cut piles are minimized, and as a result, a cut pile carpet having a flat cut surface can be obtained.

It is preferable that a pile yarn having a denier of between 600 de and 6000 de be tufted by means of a tufting machine having a gauge of between 5/64 inch and 5/32 inch.

If the cohesive bulky yarn has been dyed simultaneously with the heat treatment under the constrained condition, the carpet is subjected to a finishing operation, such as a shearing operation, subsequent to the tufting operation. If coloring agent is added before a yarn is melt spun from a spinneret, the yarn is subjected to only the heat treatment and is not subjected to a dyeing operation. In this case, since the latent torque in the yarn is relaxed and the crimp in the yarn is thermally stabilized because of the heat treatment, the free ends of the cut piles do not turn or curve while the carpet is subjected to a high temperature during a subsequent operation, such as drying operation. As a result, the cut surface becomes smooth and it is easy to carry out the shearing operation.

Since the pile yarn which has been subjected to the present second process has only a very small latent torque therein, the advantage in that true twists are developed in the pile yarn because of the rotation of the cut pile created by the latent torque cannot be expected. However, instead the gathering effect of the true twisted yarn can be replaced by another gathering effect which is effected by enhancing the partial adhesion of the filaments constituting the yarn during the false twisting and thermal adhering operation, and by increasing alternate twists, i.e., S and Z twists. Accordingly, in order to obtain a satisfactorily high gathering effect, it is preferable that the yarn have a coherent factor of at least 20. However, if the coherent factor is too high, the hand may become too hard, and accordingly, it is preferable that the coherent factor of the cut pile yarns in the cut carpet produced in accordance with the present second process be between 20 and 60.

With reference to the accompanying drawings, the present invention will now be explained in detail.

BRIEF DESCRIPTION OF THE DRAWINGS

Referring to FIG. 1, a bulky yarn 1 withdrawn from a package P is wound around a feed roller 2 several times and is fed at a predetermined constant speed. It is preferable that a separate roller 3 disposed in parallel with the feed roller is grooved around the peripheral surface thereof so that the passage of the yarn 1 can be stable. A roller 4 which is freely rotatable is pressed on the surface of the feed roller 2 so as to nip the yarn 1 therebetween so that twists running back from the down-stream thereof are prevented from running back to the upstream. Thereafter, the bulky yarn 1 is fed to a heater 5 where it is heated to a temperature higher than the softening point of the yarn. It is preferable that the heater 5 is of a non-contact type pipe heater as illustrated in FIG. 1 and that the yarn is directly heated by means of steam which can easily cause adhesion of a polyamide yarn. The yarn 1 leaves the heater 5 then enters a false twist nozzle (air torque jet) 6 wherein a calculated gas flow is utilized where false twists are imparted to the yarn 1. The false twists run back along the yarn 1 in the heater 5 and reach the nip line between the feed roller 2 and the press roller 4. The number of the false twists imparted by the false twist nozzle 6 is required to be between 100 T/m and 1000 T/m. If the number of the twists is less than that range, the self-twisting effect due to the latent torque is low. On the other hand if the number of the twists is more than 1000 T/m, it is very difficult to stably impart twists to the yarn 1.

Figure 1:
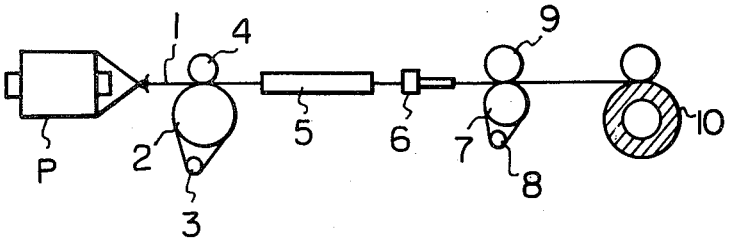
FIG. 1 is a diagrammatical side view of a device wherein a false twisting and thermally and partially adhering method of the present invention is carried out.

It is possible that the heater 5 and the false twist nozzle 6 are connected to each other and the single and same heated gas supplied to both of the parts. However, in this case, since the yarn will be wound while it is hot, the quality of the obtained yarn may be degraded. It is preferable that the heater 5 and the false twist nozzle 6 are separately disposed as illustrated in FIG. 1 and that in the twist nozzle 6 the false twists are imparted while the yarn is cold by means of air at a normal temperature.

It is also preferable that, if the heater is of pipe heater type and is supplied with saturated or super-heated steam as a heating medium, the inner diameter d in mm of the inlet and outlet thereof satisfy the following equation:

$$0.023\sqrt{De} \leq d \leq 0.023\sqrt{De}+0.5$$

wherein De is the thickness in denier of a yarn to be heat treated. When the diameter d selected is in the range mentioned above, the filaments in the yarn can be thermally and partially adhered because the steam introduced into the heater does not escape freely through the inlet and outlet, so that the pressure in the heater is maintained high, and the yarn may not be damagned while it passes through the inlet and outlet because the inner diameter d of the inlet and outlet is larger than the diameter of the yarn.

The means for imparting false twists to the yarn may be not only a false twist nozzle 6 as explained above, but also any other false twisting means such as a friction false twisting means. In the above-mentioned false twisting nozzle 6, the partially adhered portions in the bulky yarn, i.e., the tight spots, created within the heater 5 are not detwisted, so that they easily remain in the bulky yarn as alternate twists, i.e., S and Z twists; as a result, the nozzle 6 is preferable because the coherency of the bulky yarn is increased.

The yarn thus false twisted is wound around a take up roller 7 several times and is advanced to a winder 10 where it is formed into a package. A separate roller 8, disposed rotatably and in parallel with the take up roller 7 is grooved around the peripheral surface thereof so that the yarn is stably advanced on the take up roller 7. It is preferable that a rotatable roller 9 is pressed against the take up roller 7 so as to nip the yarn therebetween so that the false twists are prevented from running into the winding means.

In this method, when the heating conditions of the heater 5, i.e., the temperature and the pressure of steam, if steam is utilized as a heating medium, the number of false twists, the tension in the yarn while it is treated, are varied, the total crimp, the coherent factor, the latent torque index of the bulky carpet yarn thus obtained can be changed to the desired values. In general, in the method of the present invention, since the false twisting and thermally adhering operation takes place under a certain tension, the total crimp of the obtained carpet yarn is a little bit smaller than that of the feed yarn. Accordingly, the total crimp of the produced yarn is in a range between 3% and 15%, which range is preferable for a pile yarn of a cut pile carpet.

Figure 7:
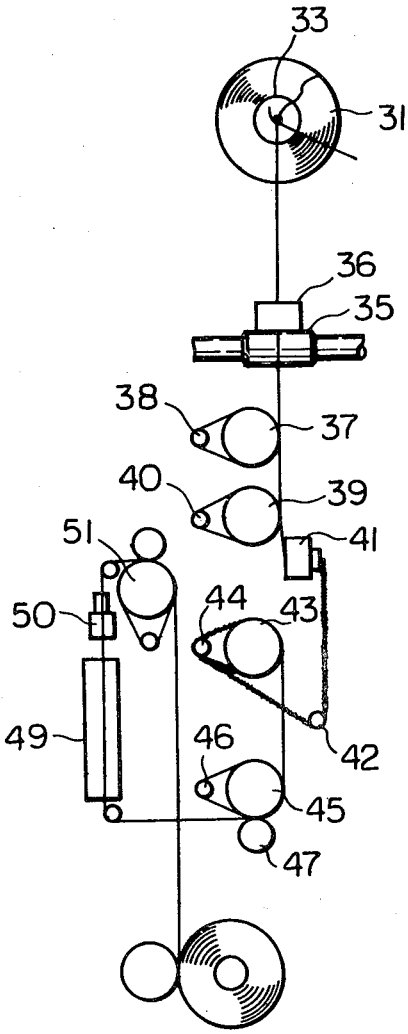
FIG. 7 is a diagrammatical elevational view of a draw texturing machine type device wherein an undrawn yarn is draw textured, and then, is subjected to a false twisting, and thermally and partially adhering operation according to the present invention.
Figure 8:
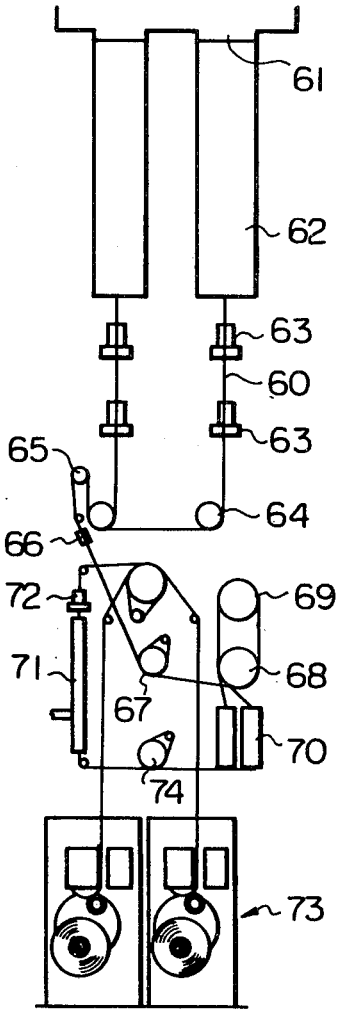
FIG. 8 is a diagrammatical elevational view of a spin draw texturing machine type wherein an undrawn yarn is melt spun and is draw-textured, and then, is subjected to a false twisting, and thermally and partially adhering operation according to the present invention.

In the embodiment of FIG. 1, a bulky multifilament yarn which has been previously manufactured through an operation for imparting crimps is fed to a false twisting and heat setting operation. It is possible that the operation for imparting crimps and the operation for false twisting and heat setting are continuously carried out as illustrated in FIG. 7. Furthermore, the operations for imparting crimps and for false twisting and heat setting may be carried out together with the operation for spinning and drawing as illustrated in FIG. 8.

In accordance with the above-explained method of the present invention, only when a bulky polyamide multifilament yarn is passed through a false twisting and heat setting process, a bulky cohesive polyamide multifilament yarn which has suitable bulkiness, coherency and latent torque and which is preferable as a pile yarn for a cut pile carpet can be manufactured. Accordingly, the method is superior in productivity to the conventional method, wherein additional twisting and heat setting are carried out. Since the construction of the equipment is simple, the manufacturing cost according to the present invention can be lowered. When the method is compared with a method wherein a yarn is entangled by means of interlacing, no special nozzle for imparting entanglement to the yarn is required, and the produced yarn is free from dyeing specks.

Figure 2:
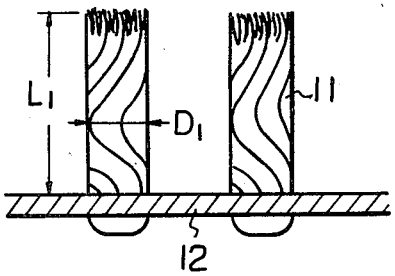
FIGS. 2 and 3 are partially enlarged views of a carpet wherein piles before and after operation for developing true twists according to the present invention takes place are illustrated, respectively.
Figure 3:
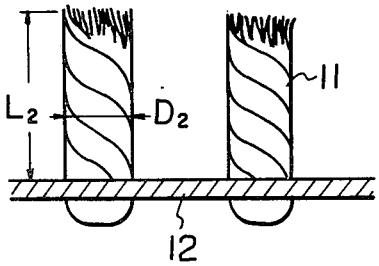
Figure 5:
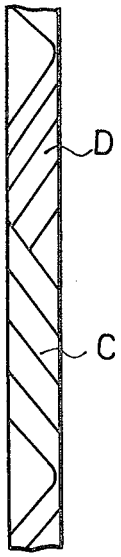
Figure 9:
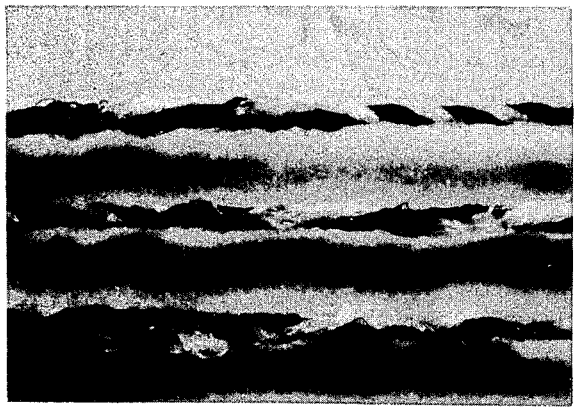
FIGS. 9 and 10 are photographs which illustrate bulky cohesive multifilament yarns according to the present invention before and after the latent twists developing operation, respectively, and wherein when one half of the filaments in each yarn were coloured black it was subjected to the false twisting, and partially and thermally adhering operation according to the present invention.
Figure 10:
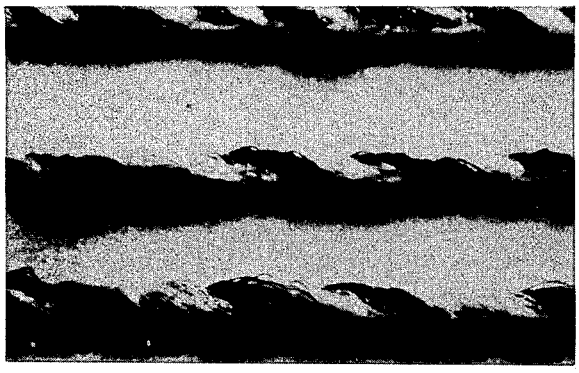

With reference to FIGS. 2 and 3, cut pile carpet yarns are illustrated wherein the bulky carpet yarn manufacturing in accordance with the above-mentioned method is utilized. In FIGS. 2 and 3, the reference numerals 11 and 12 designate a pile and a substrate, respectively. In accordance with a first process according to the present invention, just after the cut piles 11 are formed, as illustrated in FIGS. 2 and 5, alternate twists comprising S and Z twist portions are in the piles 11. The alternate twists are also illustrated in FIG. 9. However, after the operation for developing true twists is carried out by means of steam or hot water, true twists, i.e., S twists, the direction of which is the same as that of the false twists, i.e., S twists, are developed as illustrated in FIGS. 3, 6, 10 and 11. After the operation, there are tendencies that the length of the pile 11 is somewhat shortened from $L_1$ to $L_2$, and that on the other hand, the thickness of the pile 11 is somewhat increased from $D_1$ to $D_2$. If the thermal shrinkage ratio, the coherency and the latent torque index of the bulky yarn utilized for a pile yarn are adequately selected, the changes in size during the operation can be minimized.

Figure 11:
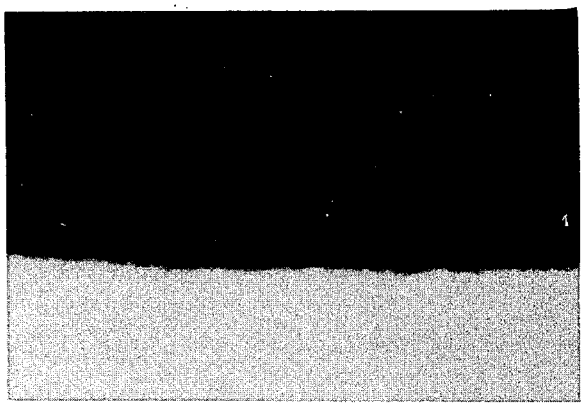
FIG. 11 is a photograph illustrating a side view of a carpet wherein a yarn according to the present invention is utilized as cut piles.
Figure 12:
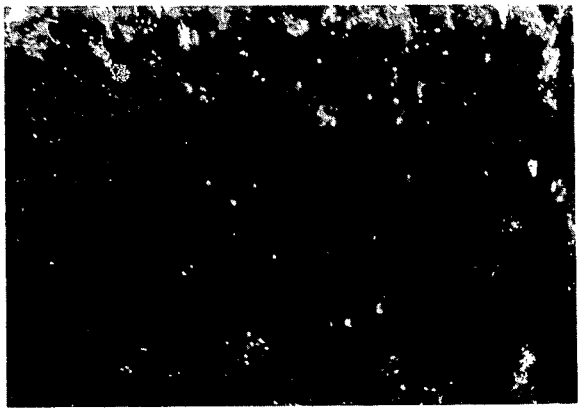
FIG. 12 is a photograph illustrating a plan view of the carpet in FIG. 11.

As illustrated in FIG. 12, which is a plan view of FIG. 11, the carpet thus obtained through the first process of the present invention has a very excellent pinpoint effect.

According to the first process of the present invention, during the operation for developing the true twists, if the conditions for treating, i.e., temperature and time duration, are varied locally, the coherency of the pile whose conditions are varied can be changed. Accordingly, even if the same bulky carpet yarn is tufted on a carpet as a pile yarn, a pattern can be applied to the carpet by locally changing the heat treating conditions.

Naturally it is possible to apply a pattern to a carpet by locally changing the kinds of density or cut length of bulky carpet yarns. In such a case, it is also possible to facilitate patterning by locally changing the operational condition for developing true twists.

According to the second process of the present invention, the cut pile carpet yarn manufactured in accordance with the method explained above with reference to FIG. 1, which yarn is illustrated in FIGS. 5 and 9, is subjected to a heat relaxation treatment under a constrained condition, for example while the yarn is formed in a cheese, so that the latent torque index of the bulky yarn is lowered to less than 60 T/m. The alternate twists in the yarn are heat set because the rotation of the yarn is constrained and, accordingly, a yarn having alternate twists similar to the yarn illustrated in FIGS. 5 and 9 is obtained. The obtained yarn with alternate twists is tufted as a pile yarn and the loops of the pile yarn are cut. As a result, a cut pile carpet having a construction similar to that illustrated in FIG. 2 is obtained.

Methods for measuring the total crimp, the coherent factor, the latent torque index, the adherent ratio, the bulkiness and the number of loops utilized in this specification will now be explained in detail.

(1) Total Crimp (TC)

The total crimp indicates the degree of crimp of a yarn. A bulky yarn of one meter length is withdrawn from a package, and it is loaded under 0.1 g/de for one minute. After the crimp is developed in boiling water for 30 minutes while the test piece is in a free condition, the test piece is dehydrated, and then it is dried for one day and night under normal conditions. The test piece is loaded for one minute under 0.1 g/de and the length thereof $l_1$ is measured. After the test piece is maintained in a free condition for three minutes, while it is loaded for one minute under 2 mg/de, the length of the test piece $l_2$ is measured. Based on the measured data, the total crimp (TC) is calculated in accordance with the following equation.

$$TC = \frac{l_1 - l_2}{l_1} \times 100\ (\%)$$

(2) Coherent Factor (CF)

The coherent factor indicates the degree of coherency of a yarn. A yarn, ends of which are free, is located horizontally, and then the yarn is vertically separated into two portions along the axis thereof. The upper half portion of the yarn is picked up by a hook, and the remaining lower half portion of the yarn is vertically loaded under 0.2 g/de, the amount being calculated for the total denier of the yarn. The width W in cm between the upper and lower half portions is measured. The coherent factor (CF) is calculated in accordance with the following equation.

$$CF = 100/W$$

Note that the length of the test piece is equal to or more than 50 cm and the test piece is randomly sampled. If the coherent factor is large, the coherency of the yarn is high.

(3) Latent Torque Index

A bulky yarn of 30 cm length is sampled from a cheese, and a mark is put at one end of the yarn by means of an oily ink. The yarn is hung in saturated steam (about at 100° C.) for five minutes while one end thereof is free, and the number of twists which are created by rotation of the yarn is counted. The number of the twists is converted into the number of the twists per meter which is called the latent torque index. If the index is large, the torque latently included in the yarn is high.

(4) Adherent Ratio

A microscopic photograph of the cross section of a yarn is taken, and the number of the portions where the boundary between the adjacent filaments is not clearly observed, which portions are considered as adhered portions, is counted. (Since the adhesion is caused by a point contact, if two or more portions of the yarn are not clear, two or more portions are counted individually.) The counting operation utilizing the cross sectional microscopic photograph is carried our over ten times with respect to the test pieces which are randomly sampled along the lengthwise direction of the yarn. The arithmetical average of the obtained numbers is calculated and is called the number of adhesions. The adherent ratio is calculated in accordance with the following equation.

$$\text{Adherent Ratio} = \frac{\text{Number of Adhesions}}{\text{Number of Filaments Composing Bulky Yarn}} \times 100\ (\%)$$

(5) Bulkiness

A bulky continuous multifilament yarn is wound to form a skein, and after the skein is heat treated in boiling water for 30 minutes, while it is in a free condition, it is dehydrated and dried for one day and night under normal conditions, i.e., at the temperature of 20° C. and the relative humidity of 65%.

The yarn, after it is subjected to an operation for developing twists, is wound 100 times around a reel having a width of 10 cm, under a tension of 4 mg/de. Utilizing the volume of the wound yarn V in $cm^3$, which is calculated based on the thickness of the wound yarn layer and the width of the reel, and the weight of the yarn W in g, the bulkiness is calculated by the following equation.

$$\text{Bulkiness} = V/W (cm^3/g)$$

(6) Number of loops

A bulky continuous multifilament yarn 10 cm long is placed on a black mount and is sandwiched between the mount and a transparent plate glass. In this specification, the term "loop" is defined as a yarn portion projecting more than 0.5 mm high upwards or downwards from the periphery of the yarn while the yarn is sandwiched between the mount and the glass as mentioned above. The loops are counted and, then, the number of loops per cm is obtained.

Examples of the present invention will now be explained. In Examples 1 and 2, the tufting operability is judged on the number of the defects of the tuft, i.e., stitch damages caused by the fallen piles. If the number is less than 0.01 per one $m^2$, the tufting operability is expressed with the term "excellent". If the number is between 0.01 and 0.1 per one $m^2$, the tufting operability is expressed with the term "acceptable". If the number is more than 0.1 per one $m^2$, the tufting operability is expressed with the term "poor". The appearance of a carpet is judged on the subjective tests effected by an expert.

EXAMPLE 1

A multifilament yarn of nylon 6 containing $TiO_2$ as a delusterant of 0.06% by weight, each filament of which yarn has a trilobal cross section, is impinged upon a wire net by means of a heated fluid jet nozzle. As a result, a bulky continuous multifilament yarn of nylon 6 having the following properties is manufactured, and it is fed to the false twisting and heat setting device, illustrated in FIG. 1, so that it is false twisted and heat set.

| Fed Bulky Yarn | |
|---|---|
| Thickness | 2500 denier/136 filaments |
| Total Crimp | 15% |
| Bulkiness | 16 $cm^3/g$ |
| Number of Crimps | 400/m |
| Coherent Factor | 100/14 |
| Latent Torque Index | 0 T/m |

In the above-mentioned example, the heater 5 was a pipe heater and had a length of 300 mm and an inner diameter of 5 mm. The inlet and outlet ends of the heater 5 were choked like an orifice, the inner diameter of which was 1.5 mm. Within the pipe heater 5, superheated steam, the temperature of which was 200° C. and the gauge pressure of which was between 2.0 $kg/cm^2$ and 3.0 $kg/cm^2$, was introduced. On the other hand, the false twisting nozzle 6 was provided with a yarn passage of a pipe-shape having an inner diameter of 3 mm. An air inlet of a slit shape having a depth of 0.5 mm and a width of 3 mm was disposed tangentially to the yarn passage, so that a circulated air flow was created within the yarn passage. The treating speed was selected as 500 m/min, the overfeed ratio of the yarn while it was treated was selected as 5%. The pressure of the air at room temperature fed to the false twisting nozzle was variously changed and the tests were repeated.

Various properties of the bulky yarns obtained through the tests were measured, and at the same time the yarns were tufted to substrates, i.e., jute fabrics, as pile yarns so that cut pile carpets were manufactured. The tufting machines were selected to be of a gauge of 5/32 inch, a pile stitch of 9 per inch and a pile height of 20 mm. The obtained carpets were dyed in boiling water so that the torque in the piles were developed. The appearances and hands of the carpets were judged on the above-mentioned criteria. The results are described in Table 1.

TABLE 1

| Data No. | | 1 | 2 | 3 | 4 | 5 | 6 | 7 |
|---|---|---|---|---|---|---|---|---|
| Conditions | | | | | | | | |
| Pressure of air | Kg/cm$^2$ | 0 | 1.0 | 2.0 | 3.0 | 4.0 | 5.0 | 5.0 |
| Number of false twists | T/m | 0 | 80 | 150 | 380 | 450 | 500 | 500 |
| Pressure of steam | Kg/cm$^2$ | 2.0 | 2.0 | 2.0 | 2.0 | 2.0 | 2.3 | 3.0 |
| Bulky yarn | | | | | | | | |
| Total crimp | % | 13.0 | 9.0 | 7.0 | 7.0 | 6.5 | 6.0 | 4.3 |
| Bulkiness | cm$^3$/Kg | 14 | 12 | 11 | 10 | 9.6 | 9.0 | 6.5 |
| Adherent ratio | % | 0 | 1.8 | 4.8 | 10 | 20 | 25 | 45 |
| Coherent factor | — | 7.1 | 12.0 | 18.2 | 21.7 | 28.6 | 33.3 | 66.7 |
| Latent torque index | T/m | 0 | 30 | 60 | 90 | 100 | 110 | 150 |
| Tufting operability | | poor | acceptable | excellent | excellent | excellent | excellent | excellent |
| Appearance of carpet | | poor | good | good | good | excellent | excellent | poor |
| Hand of carpet | | Felt-like | Velvet-like | | Hard | twist like | | Too stiff |

In the Table 1, the test resulting in Data Nos. 2 through 6 were carried out in accordance with the present invention, and since the obtained bulky yarns had suitable coherencies, which were the second set of effects of the crimp and the latent torques, the carpets manufactured therefrom were characterized by superior qualities, both in appearance and hand, because the piles in the carpets stood vertically. On the other hand, in the test resulting Data No. 1 wherein the pressure of the air was selected to be zero so that no false twists were imparted to the yarn, low coherecy was obtained in the yarn because the filaments were not adhered. In the test resulting in Data No. 7, wherein the pressure of the steam was raised excessively, excessive adhesion was created to the filaments, and the bulky yarn became stiff like a string and the bulkiness thereof also became degraded.

EXAMPLE 2

Using the method of Example 1, the pressure of the air supplied to the false twisting nozzle 6 is selected at 5.0 kg/cm$^2$, and the pressure of the steam supplied to the heater 5 was changed variously. The results are described in Table 2.

In the test resulting in Data Nos. 8 and 9 wherein no steam and steam of low pressure were supplied to the heater, respectively, there was no adhesion, and therefore the coherency of the obtained bulky yarn was low. Since the latent torque index was also low, not only the tufting operability was degraded but also the obtained cut pile carpets were felt-like and the quality thereof was low. As the pressure of the steam was increased as described in the test resulting in Data Nos. 10 through 12, there was suitable adhesion, and the coherency and the latent torque index were increased. As a result, various types of carpet of high quality from a plush type carpet, wherein twists were small, to a hard twist type carpet were obtained.

TABLE 2

| Data No. | | 8 | 9 | 10 | 11 | 12 | 13 |
|---|---|---|---|---|---|---|---|
| Conditions | | | | | | | |
| Pressure of steam | Kg/cm$^2$ | 0 | 1.0 | 1.0 | 1.8 | 2.5 | 4.0 |
| Number of false twists | T/m | 500 | 500 | 500 | 500 | 500 | 500 |
| Bulky Yarn | | | | | | | |
| Total crimp | % | 16.0 | 13.0 | 9.8 | 7.0 | 6.0 | 4.0 |
| Bulkiness | cm$^3$/g | 16.5 | 14.8 | 12.0 | 10.5 | 9.0 | 7.0 |
| Adherent ratio | % | 0 | 0 | 2.5 | 10 | 25 | 5.0 |
| Coherent factor | — | 3.6 | 4.5 | 5.9 | 12.5 | 33.3 | 14.3 |
| Latent torque index | T/m | 0 | 18 | 50 | 80 | 110 | 140 |
| Tufting operability | | poor | poor | excellent | excellent | excellent | excellent |
| Appearance of carpet | | poor | poor | good | excellent | excellent | poor |
| Hand of carpet | | Felt-like | | | Good | | Too stiff |

However, if the pressure of the steam was too excessive, as described in the test resulting in Data No. 13, there was excessive adhesion, and therefore the yarn cohered like a string and the hand of the carpet became hard.

EXAMPLE 3

A bulky polyamide multifilament yarn of 3200 de/272 fil which was composed of a nylon 6 filament having a trilobal cross section, the modification ratio of which was three and which had a total crimp of 14%, was fed to an air false twist nozzle at a speed of 500 m/min so that false twists of 300 T/m were imparted into the yarn, and then the false twists were heat set and thermally and partially adhered by means of a pipe heater, having a length of 40 cm, where superheated steam, the gauge pressure of which was 2.0 kg/cm$^2$ and the temperature of which was 200° C., was utilized. A bulky cohesive multifilament yarn, having an adherent ratio of 5% a total crimp of 8% and a latent torque index of 50 T/m, and comprising alternate twists, i.e., S and z twists, was obtained. The obtained bulky yarn was utilized as a pile yarn, and a cut pile carpet was manufactured in accordance with a tufting method. The conditions of the tufting machine were the same as those of the tufting machines utilized in Example 1.

Since the pile yarn had good coherency due to the alternate twists, the tufting operability was very good. The operative efficiency was three times as good as that which was obtained for the bulky multifilament yarn having no twists.

When the cut pile carpet was dyed in boiling water, it was uniformly dyed without any dyeing specks, and the torque in the pile yarn was developed so that true twists of about 50 T/m were developed in each cut pile and so that the piles became circular. As a result, a velour type carpet was obtained.

The obtained cut pile carpet was placed on a busy corridor, and one month after the carpet was placed there, the coherency of the piles was observed and it was found that the piles maintained coherency which was almost the same as that when it was initially placed there.

EXAMPLE 4

Referring to FIG. 7, a continuous undrawn yarn of nylon 6 multifilament yarn 31 melt spun and wound around a bobbin 33 was prepared. The yarn was of 4800 denier/136 fil, and each filament had a trilobal cross section, the modification ratio was 3.5. The yarn 31 was withdrawn from the bobbin 33 and was slightly prestretched between a feed roller 35 with a press roller 36 and a prestretch roller 37 with a rotatable separate roller 38. After the yarn 31 was wound around the prestretch and separate rollers 37 and 38 several times, it was advanced to a draw roller 39 with a rotatable roller 40 and wound therearound several times. The ratio between the peripheral speeds of the feed and draw rollers 35 and 39, i.e., draw ratio, was 3.70. The draw roller 39 was heated at a temperature of 185° C. and had a peripheral speed of 1000 m/min. The yarn was subject to a texturing operation by means of a heated fluid jet nozzle 41 which had a construction similar to that disclosed in FIG. 2 of Japanese Patent Application Laid-Open No. 31848/78 and which utilized steam, the temperature of which was 210° C. and the pressure of which was 6.0 kg/cm$^2$. The yarn 31 was overfed to a roller 43 with a rotatable free roller 44 via a guide 42, the overfeed ratio of the yarn between the draw roller 39 and the roller 43 was 60%. The yarn 31 was drafted between the roller 43 and a draft roller 45 under various tensions in the yarn between 0 g and 1000 g. The draft roller 45 had a rotatable separate roller 46 and a press roller 47. The characteristics of the yarn thus obtained under a draft tension of 300 g are as follows.

| | |
|---|---|
| Thickness of the yarn | 1600 de |
| Total crimp | 14% |
| Number of crimps | 500/m |
| Bulkiness | 14 cm$^3$/g |
| Coherent factor | 7.1 |
| Latent torque index | 0 T/m |
| Number of Loops | 20/cm |

Figure 13:
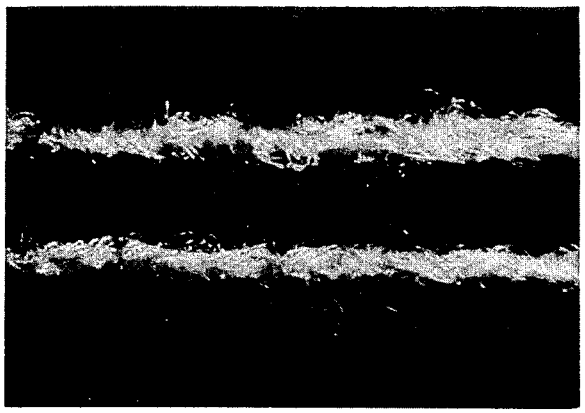
FIG. 13 is a photograph illustrating yarns which are obtained in accordance with the present invention, while loops in the yarns are left, and are subjected to the operation for developing twists.
Figure 14:
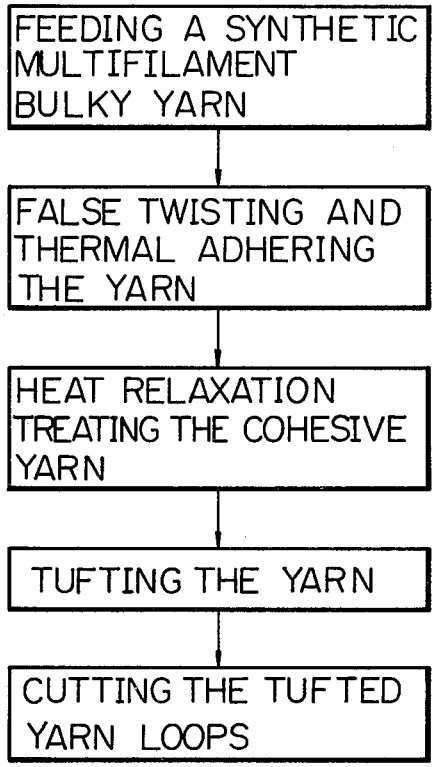
FIG. 14 is a flow chart showing the steps of a cut pile carpet manufacturing process according to a preferred embodiment of the invention.

The above-mentioned bulky continuous multifilament yarns were then continuously subjected to a false twisting and heat setting operation according to the present invention. A pipe heater 49 had a length of 400 mm and an inner diameter of 10 mm. The inner diameter of the inlet and outlet of the heater was 1.1 mm, and the heater was supplied with superheated steam, the temperature of which was 200° C. and the pressure of which was 2.3 kg/cm$^2$. A false twisting nozzle 50 was the same as that utilized in Example 1. The overfeed ratio while the yarn was false twisted was 3.0%. The pressure of the compressed air fed to the false twisting nozzle 50 was 4.0 kg/cm$^2$. An example of the obtained yarn, after it was subjected to an operation for developing twists, is illustrated in FIG. 13.

The various properties of the bulky yarns obtained were measured and, at the same time, the yarns were tufted to substrates of a plain weave of polypropylene split yarn as pile yarns, and cut pile carpets were manufactured. The tufting machines were selected to be of a gauge of 1/10 inch, a pile stitch of 9 per inch and a pile height of 15 mm. The obtained carpets were dyed in boiling water, and the appearances and hands thereof were judged based on the above-mentioned criteria. In the test resulting in Data Nos. 14 through 18, the tufting operability was good. The results are described in Table 3.

In this example, it was observed that, when a bulky continuous multifilament yarn having loops therein is false twisted, and thermally and partially adhered in accordance with the present invention, the bulkiness of the bulky cohesive continuous multifilament yarn is increased due to the remaining loops and the yarn becomes soft to the touch.

It is preferable that the total crimp of the bulky cohesive continuous multifilament yarn obtained should be between 3% and 12%, and that the number of loops of the yarn should be between 2 and 100.

TABLE 3

| Data No. | | 14 | 15 | 16 | 17 | 18 |
|---|---|---|---|---|---|---|
| Conditions | | | | | | |
| Draft tension | g | 0 | 100 | 300 | 500 | 1000 |
| Number of false twists | T/m | 650 | 650 | 650 | 650 | 650 |
| Pressure of steam | kg/cm$^2$ | 2.3 | 2.3 | 2.3 | 2.3 | 2.3 |
| Bulky yarn | | | | | | |
| Total crimp | % | 6.0 | 7.0 | 7.5 | 6.4 | 5.0 |
| Number of loops | /cm | 280 | 90 | 25 | 6 | 0 |
| Bulkiness | cm$^3$/g | 9.5 | 8.0 | 7.5 | 7.0 | 6.0 |
| Adherent ratio | % | 14.0 | 18.0 | 20.0 | 24.0 | 28.0 |
| Coherent factor | — | 24.0 | 33.0 | 30.0 | 28.0 | 16.0 |
| Latent Torque Index | T/m | 60 | 123 | 120 | 100 | 80 |
| Carpet | | | | | | |
| Appearance of carpet | | good | excellent | excellent | excellent | good |
| Hand of carpet | | low | worsted spun yarn like | | | a little |

TABLE 3-continued

| Data No. | 14 | 15 | 16 | 17 | 18 |
|---|---|---|---|---|---|
| | pin-point effect | | | | bit stiff |

EXAMPLE 5

Referring to FIG. 8, a pair of nylon 6 multifilament yarns, wherein each filament had a trilobal cross section, were melt spun from a spinning nozzle 61 and cooled while they advanced within cooling chambers 62. After the yarn 60 was subjected to an finishing operation by means of a pair of finishing rollers 63, which were driven at a relatively low speed, the yarn 60 was turned by a turn-over roller 64 and taken up by means of a godet roller 65. The peripheral speed of the godet roller 65 was about 770 m/min. A multifilament nylon 6 undrawn yarn of SB 3000 de/68 fil was obtained. A nozzle 66 for entangling filaments in a yarn was disposed between the godet roller 65 and a feed roller 67 so that the finish imparted to the yarn 60 at the finishing rollers 63 was uniformly distributed between the filaments. The feed roller 67 was heated at a temperature of 50° C. The yarn was drawn between the feed roller 67 and a pair of draw rollers 68 and 69, which were heated at a temperature of 195° C., and the peripheral speed of which was 2500 m/min. The draw ratio was 3.43 and a drawn yarn having thickness of 875 de/68 fil was obtained. The obtained drawn yarn, which was preheated on the draw rollers 68 and 69, was then subjected to a crimping operation by means of an air stuffing device 70, which had a construction similar to that disclosed in Japanese Patent application Laid-open No. 45420/78 and wherein superheated steam, the temperature of which was 190° C. and the pressure of which was 5 kg/cm$^2$, was utilized. The above-mentioned crimping operation was effected while the yarn was overfed from the draw rollers 68 and 69 to a delivery roller 74, since the peripheral speed of the delivery roller 74 was 2000 m/min. The over feed ratio was 25%. The bulky multifilament yarn thus obtained was then supplied into a pipe heater 71 for thermally and partially adhering the false twists imparted to the yarn by means of a false twisting air nozzle 72 and run back along the yarn. The pipe heater 71 had a length of 600 mm and an inner diameter of 10 mm. The inner diameter of both the inlet and outlet of the heater 71 was 1.2 mm; and the heater was supplied with superheated steam, the temperature of which was 195° C. and the pressure of which was 3 kg/cm$^2$. The false twisting air nozzle 72 was supplied with compressed air, the pressure of which was 4.0 kg/cm$^2$. The bulky cohesive multifilament yarn thus obtained was taken up by means of a winding apparatus 73 disclosed in U.S. Pat. No. 4,033,519. The winding speed of the apparatus 73 was 1950 m/min.

The properties of the obtained bulky cohesive continuous multifilament nylon 6 yarn and the carpet wherein the yarn was utilized were as follows.

| | |
|---|---|
| Thickness in denier of the yarn | 1000 de/68 fil |
| Total crimp | 6.0% |
| Coherent factor | 40 |
| Bulkiness | 9.0 cm$^3$/g |
| Adherent ratio | 25 |
| Latent torque index | 150 T/m |
| Tufting operability | 0.6/hr |

-continued

| | |
|---|---|
| (Break down ratio of the tufting machine) | |
| Appearance of carpet | excellent |
| Hand of carpet | worsted spun yarn like |

EXAMPLE 6

A bulky polyamide multifilament yarn of 1600 de/136 fil which was composed of a nylon 6 filament having a Y shaped cross section, the modification ratio of which was two and which had a total crimp of 16%, was false twisted at a speed of 500 m/min by means of an air false twisting nozzle, so that false twists of 600 T/m were imparted to the yarn. The false twists were heat set and thermally and partially adhered by means of a pipe heater, having a length of 40 cm. The inner diameter of the inlet and outlet of the heater was 1.2 mm. In the heater, superheated steam, the gauge pressure of which was 2.0 kg/cm$^2$ and the temperature of which was 220° C., was utilized. A pile yarn of an alternate twisted yarn type, having an adherent ratio of 30%, a total crimp of 7% and a latent torque index of 150 T/m, was obtained.

The pile yarn was tufted on a substrate by means of a tufting machine, the gauge of which was 1/10 inch, so that a cut pile carpet of hard twist having a pile stitch of ten per inch and a pile height of 20 mm was obtained. The tufting operatibility was very good, and the suspension ratio of the operation was decreased to that of one fifth of non-twisted pile yarn.

When the cut pile carpet was treated in boiling water, true twists of about 100 T/m were developed in each pile, and a carpet having a quality which was equal to that of a carpet utilizing a known cohesive bulky yarn was obtained through the twisting and heat setting.

The obtained cut pile carpet was placed on a busy corridor, and one month after the carpet was placed there, in coherency of the piles was observed and it was found that the piles maintained coherency which was almost the same as that of when it was initially placed there.

Figure 4:
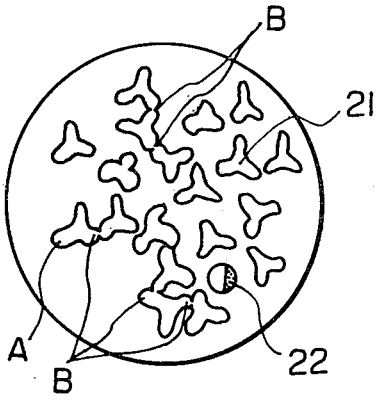
FIGS. 4 and 5 are a cross sectional enlarged view and an enlarged side view, respectively, of another cut pile carpet according to the present invention.

With reference to FIG. 4, it is preferable that a cohesive bulky synthetic multifilament yarn, which is utilized as a pile yarn, is composed of filaments, at least 50%, preferably more than 80% of which are trilobal cross sectional filaments, each of which has three projections A, and the filaments are thermally and partially adhered to each other. In the cohesive bulky synthetic multifilament yarn, since almost all the filaments are modified cross sectioned filaments having a trilobal cross section and three projections in its cross section, almost all the adhered portions B are located at the projections A, and the filaments are adhered to each other in point contact. As a result, although the whole yarn has a suitable coherency due to the adhesion, the hand of the yarn is not so stiff as the usual adhered yarn, but is very soft.

The degree of adhesion should be determined based on the degree of coherency and hand which are required of a pile yarn. If a velour-like carpet is desired, it is preferable that the adherent ratio be between 0.5% and 20%. If a hard twist like carpet is desired, it is preferable that the adherent ratio be between 20% and 40%.

Please note that the pile yarn illustrated in FIG. 4 includes not only modified cross sectioned filaments 21 but also electrically conductive conjugate filaments 22 comprising a non-conductive constituent of nylon 6 and an electrically conductive constituent of nylon 6 and carbon black so that the yarn can prevent electricity.

Figure 6:
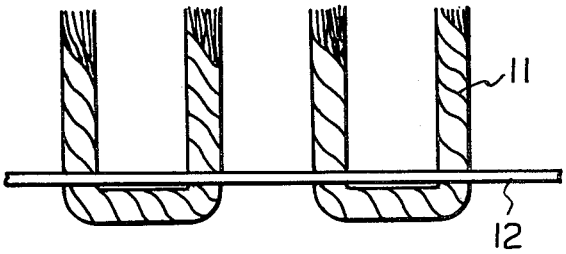
FIG. 6 is a partly enlarged view of a pile after the cut pile carpet illustrated in FIGS. 4 and 5 is subjected to treatment for developing torque.

The pile yarn utilized in a cut pile carpet has filaments partially and thermally adhered to each other as mentioned above. At the same time as illustrated in FIG. 5 the yarn has alternate twists, i.e., S and Z twist portions (designated by the reference C and D in FIG. 5, respectively) distributed randomly along the lengthwise direction thereof. As a result, the whole yarn has a circular cross section, as a true twist yarn has, and is coherent. Furthermore, the yarn has a latent torque, i.e., the property to rotate by itself when it is heat treated while its one end is held and the other end is free. As a result, when the yarn 11 is tufted on a substrate 12 to form piles, and when the piles are heat treated after the piles are cut, the true twists are developed and the filaments in each pile yarn cohere as illustrated in FIG. 6.

EXAMPLE 7

A multifilament yarn composed of a nylon 6 filaments having a trilobal cross section, the modification ratio of which was 2.0, was subjected to a texturing operation by means of a heated fluid jet nozzle, the texturing speed of which was 1000 m/min, after it had been drawn. As a result, a bulky multifilament yarn composed of nylon 6 filaments of 1300 denier/136 filaments was obtained. Subsequent to the texturing operation, false twists of 700 T/m were imparted to the obtained drawn bulky multifilament yarn by means of an false twisting air nozzle. Thereafter, the false twists imparted to the yarn were heat set, and thermally and partially adhered to each other in a pipe heater 50 cm long, the diameters of the inlet and outlet of which were 1.1 mm, by means of superheated steam, the temperature of which was 200° C. and the gauge pressure of which was 2.0 kg/cm$^2$. A bulky cohesive multifilament yarn, having a total crimp of 6.0%, a coherent factor of 60 and a latent torque index of 120 T/m, wherein filaments were partially and thermally adhered to each other like an alternate twisted yarn, was obtained.

The obtained cohesive bulky yarn was soft wound by means of a cheese winder so that a package having a winding density of 0.2 g/cm$^3$ was formed. Dyeing fluid, with a temperature which was controlled so that it was between 80° C. and 100° C., was circulated through the package for one hour, so that the yarn in the package was dyed and at the same time heat treated. After being subjected to the dyeing operation, in other words, heat treating operation, the latent torque index of the bulky yarn was decreased to 25 T/m, however, the coherent factor was 55 and the total crimp was 4.5%. Accordingly, cohesion due to the alternate twists was satisfactory for a pile yarn of a cut pile carpet.

The bulky yarn thus obtained was tufted as a pile yarn, on a substrate made of a polypropylene split yarn, by means of a tufting machine. The tufting machine was selected to be of a gauge of 5/64 inch, a pile stitch of 10 per inch and a pile height of 15 mm. The loops of the pile yarn were cut and the cut surface of the carpet was subjected to a shearing operation.

The cut pile carpet had cut piles vertically protruded from the substrate and the free ends of the cut piles located in the cut surface were not turned or curved. Accordingly, the shearing operation of the cut surface was very easy to carry out and a cut pile of a high quality with a smooth cut surface was obtained.

What we claim is:

1. A process for manufacturing a cut pile carpet, comprising the steps of:

(a) feeding a bulky polyamide multifilament yarn to a device for false twisting and heat setting, so that (i) false twists between 100 twists per meter and 1000 twists per meter are imparted into said bulky yarn, and (ii) while said false twists are maintained in said yarn, said bulky yarn is heat set so that filaments composing said yarn are thermally and partially adhered to each other, said heat set bulky yarn including S twist portions and Z twist portions;

(b) taking up said false twisted and heat set yarn while thermal and partial adhesions remain therein, to provide a cohesive bulky synthetic multifilament yarn having alternate twists with S twist portions and z twist portions being distributed randomly along the lengthwise direction of the yarn, with said yarn having a total crimp between 3% and 15%, a coherent factor between 5 and 100, and a latent torque index between 60 twists per meter and 300 twists per meter, and an adherent ratio between 0.5% and 40%;

(c) heat relaxation treating said cohesive bulky synthetic multifilament yarn under a constrained condition so that said latent torque index of said cohesive bulky synthetic multifilament yarn is decreased to less than 60 twists per meter;

(d) tufting said heat relaxation treated cohesive bulky synthetic multifilament yarn as a pile yarn on a substrate; and (e) cutting the loops of said pile yarn so as to create cut piles.

2. The process according to claim 1 further comprising dyeing said cohesive bulky synthetic multifilament yarn simultaneously with the step of heat relaxation treating.

* * * * *